US010827252B2

(12) United States Patent
Trainer et al.

(10) Patent No.: US 10,827,252 B2
(45) **Date of Patent: *Nov. 3, 2020**

(54) EARBUD STABILITY ANCHOR FEATURE

(71) Applicant: Apple Inc., Cupertino, CA (US)

(72) Inventors: Glenn K. Trainer, Santa Clara, CA (US); Craig M. Stanley, Campbell, CA (US); Scott C. Grinker, Belmont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/579,483

(22) Filed: Sep. 23, 2019

(65) Prior Publication Data

US 2020/0021903 A1 Jan. 16, 2020

Related U.S. Application Data

(63) Continuation of application No. 15/168,588, filed on May 31, 2016, now Pat. No. 10,433,045.

(60) Provisional application No. 62/235,471, filed on Sep. 30, 2015.

(51) Int. Cl.
*H04R 1/10* (2006.01)

(52) U.S. Cl.
CPC ..... *H04R 1/105* (2013.01); *H04R 1/1016* (2013.01); *H04R 1/1025* (2013.01); *H04R 1/1058* (2013.01); *H04R 2201/103* (2013.01); *H04R 2420/07* (2013.01); *H04R 2430/01* (2013.01)

(58) Field of Classification Search
CPC .... H01R 1/105; H01R 1/1016; H01R 1/1025; H01R 2430/02; H01R 2420/07
See application file for complete search history.

(56) References Cited

U.S. PATENT DOCUMENTS

2009/0034775 A1 2/2009 Burton
2009/0103764 A1* 4/2009 Stiehl ..... B29C 45/0025 381/380
2009/0214071 A1 8/2009 Axelsson
2010/0098285 A1* 4/2010 Kusuda ..... H04M 1/05 381/375

(Continued)

OTHER PUBLICATIONS

U.S. Appl. No. 15/168,588 , "Final Office Action", dated Jan. 15, 2019, 18 pages.

(Continued)

*Primary Examiner* — Sunita Joshi
(74) *Attorney, Agent, or Firm* — Kilpatrick Townsend & Stockton LLP

(57) ABSTRACT

An earbud design is disclosed that is configured to sit securely within an ear of a user. The earbud can be secured within the ear by an anchoring feature formed from an elastomeric material. The anchoring feature has a size and shape in accordance with an interior geometry of an ear of a user. Because the anchoring feature positions the earbud with respect to the ear, geometries of the earbud can be focused upon audio performance and/or device aesthetics. In some embodiments, the earbud housing can have a linear design which allows an audio driver within the earbud housing to be positioned close to an opening defined by the earbud housing. In this way, acoustic degradation associated with a long audio path from the audio driver to the opening can be avoided.

19 Claims, 7 Drawing Sheets

(56) References Cited

U.S. PATENT DOCUMENTS

| | | | | |
|---|---|---|---|---|
| 2012/0321103 | A1* | 12/2012 | Smailagic | H04R 1/1041 381/98 |
| 2013/0336514 | A1 | 12/2013 | Kelly et al. | |
| 2016/0192058 | A1* | 6/2016 | Kelly | H04R 1/1016 381/87 |
| 2016/0301999 | A1 | 10/2016 | Lott | |
| 2016/0309250 | A1 | 10/2016 | Kelly et al. | |
| 2017/0094384 | A1 | 3/2017 | Trainer et al. | |

OTHER PUBLICATIONS

U.S. Appl. No. 15/168,588 , "Final Office Action", dated Jan. 8, 2018, 19 pages.
U.S. Appl. No. 15/168,588 , "Non-Final Office Action", dated May 15, 2018, 13 pages.
U.S. Appl. No. 15/168,588 , "Non-Final Office Action", dated Jun. 30, 2017, 14 pages.
U.S. Appl. No. 15/168,588 , "Notice of Allowance", dated May 22, 2019, 9 pages.

* cited by examiner

EARBUD STABILITY ANCHOR FEATURE

CROSS-REFERENCE TO RELATED APPLICATIONS

This application is a continuation of U.S. patent application Ser. No. 15/168,588 filed May 31, 2016, which claims priority under 35 USC 119(e) to U.S. Provisional Patent Application No. 62/235,471 filed on Sep. 30, 2015, and entitled "EARBUD STABILITY ANCHOR FEATURE," the disclosure of which is incorporated by reference in its entirety and for all purposes.

FIELD

The described embodiments relate generally to features and structures of earbud style headphones. More particularly, the present embodiments relate to a design in which an earbud includes a deformable anchoring feature for orientation of the earbud with respect to an ear of a user.

BACKGROUND

Audio devices along the lines of in-ear headphones often have trouble achieving a size and shape that fits comfortably and stays securely in place for a large cross-section of users. Earbuds in particular often fall short of a design that fits comfortably within an ear of a user while achieving a high level of audio content delivery. For this reason, earbuds capable of fitting comfortably and remaining securely within the ears of a broad spectrum of ear sizes and shapes while maintaining that high level of audio content delivery are desired.

SUMMARY

This paper describes various embodiments that relate to earbud designs utilizing an anchoring feature to orient the earbud with respect to an ear of a user.

An earbud is disclosed that includes the following: an anchoring feature defining a channel extending from an first opening in a first face of the anchoring feature to a smaller second opening in an opposing second face of the anchoring feature, the anchoring feature being sized to be secured within an ear of a user; an earbud housing comprising: a central section disposed between opposing first and second faces of the earbud housing, a portion of the central section being disposed within the channel; and an audio driver disposed within the earbud housing and aligned with an audio exit opening defined by the first end of the earbud housing through which audio generated by the audio driver leaves the earbud housing.

Another earbud is disclosed that includes the following: an earbud housing having a nozzle extending away from the housing and an acoustic port formed through the nozzle; a speaker disposed within the earbud housing and aligned to emit sound through the acoustic port; a removable earbud tip formed of a deformable material and having a central opening sized and shaped to be inserted over the nozzle to attach the removable earbud tip to the housing; and a removable anchoring feature formed of a deformable material and having an opening sized and shaped to enable the removable anchoring feature to be inserted over the earbud housing to attach the removable anchoring feature to the housing such that an anchoring portion of the removable anchoring feature extends away from the housing at an angle that allows the anchoring portion to be positioned between the tragus and concha of a user's ear when the earbud tip is inserted into the user's ear canal.

Other aspects and advantages of the disclosure will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which:

FIGS. 4C-4D show perspective views of earbuds with; and

DETAILED DESCRIPTION

Figure 1:
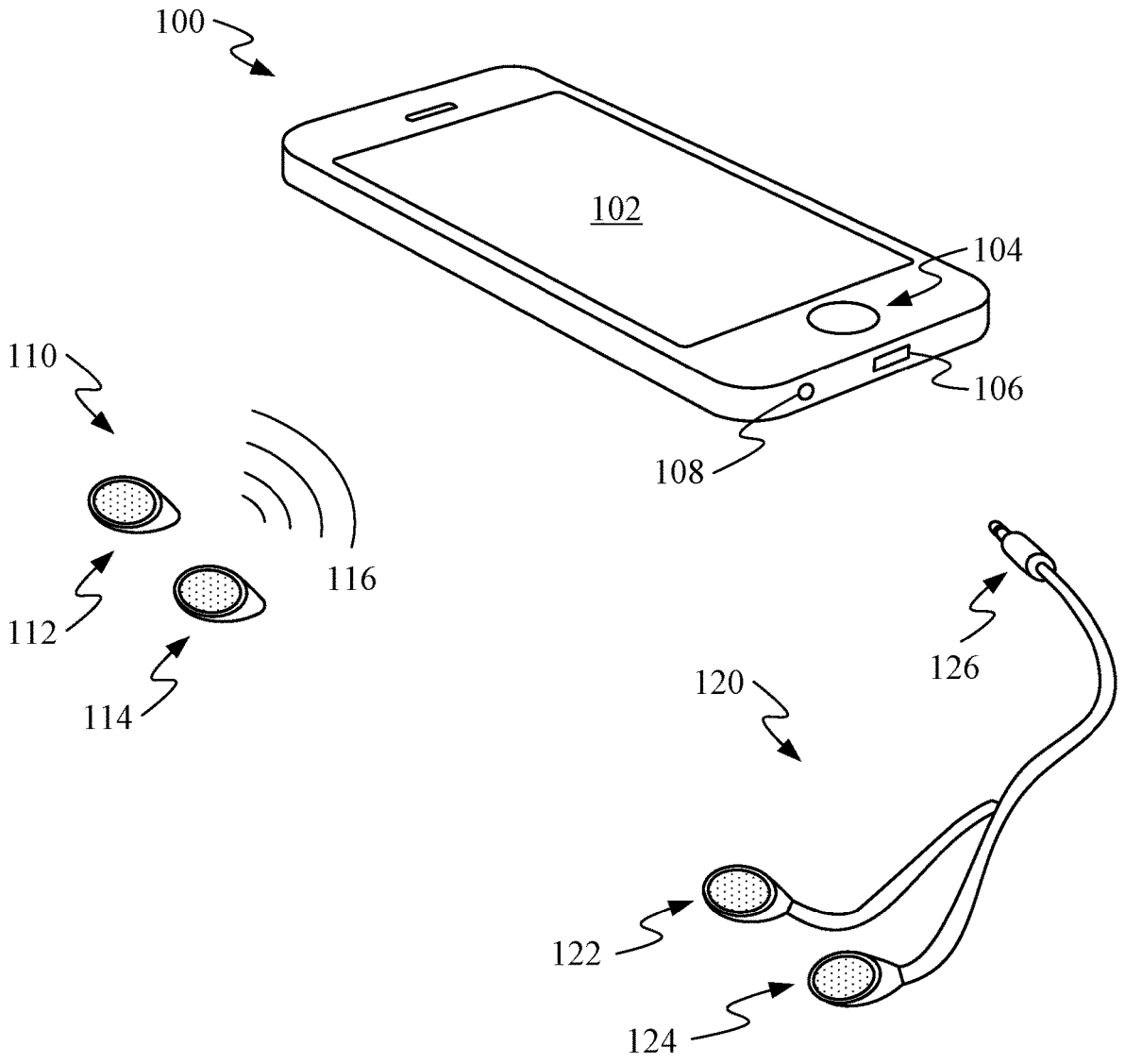
FIG. 1 shows a perspective view of a portable electronic device and a number of accessory devices suitable for use with the portable electronic device.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Earbuds can be challenging to make for a broad spectrum of users since there are such a wide variety of ear sizes and shapes. What is desired is an earbud architecture that fits both comfortably and securely within an ear of a user while maintaining excellent audio output. One solution to this problem is to design an anchoring feature that fits comfortably within an ear of a user of the earbuds. The anchoring feature can take many forms including but not limited to a volume of foam having a size and shape in accordance with a distance between the anti-tragus and tragus of a user of the earbuds. In some embodiments, other deformable materials could be included including for example, hard rubbers, silicon and plastics.

In some embodiments, the earbud can take the form of an earbud with a sealed earbud housing containing one or more balanced armature audio drivers. Balanced armature audio drivers include a coil held in place between two magnets until the coil is stimulated by an electric current. When the coil is stimulated by electric current the coil begins to oscillate at a frequency that causes the diaphragm to vibrate and generate sound waves. The sealed earbud housing structure can be important for generating quality low frequency output from a balanced armature audio driver. The earbud housing can include an attachment feature to which an anchoring feature can be attached. When the anchoring feature is coupled with the earbud housing and inserted within an ear of a user the anchoring feature can orient the earbud housing properly within the ear so that an audio exit opening of the earbud housing is well positioned proximate the ear canal of the ear. Because the anchoring feature is responsible for a secure fit and orientation of the earbud, a shape and size of the earbud housing can be optimized for audio output as opposed to having to conform to the shape of a user's ear.

In some embodiments, the earbud can have a substantially linear geometry in that both a body portion of the earbud housing that defines a substantial portion of an interior volume defined by the earbud housing and a nozzle through which sound generated by an audio driver within the interior volume exits the earbud housing are aligned in the same direction. By aligning the body portion of the housing with the nozzle, the audio driver can be placed closer to an audio exit opening defined by the nozzle. In some embodiments, a longitudinal axis of the earbud housing can pass through an opening in a nozzle portion of the earbud housing through which audio exits the These and other embodiments are discussed below with reference to FIGS. 1-5B; however, those skilled in the art will readily appreciate that the detailed description given herein with respect to these figures is for explanatory purposes only and should not be construed as limiting.

FIG. 1 shows a portable media device 100 suitable for use with a variety of accessory devices. Portable media device 100 can include touch sensitive display 102 configured to provide a touch sensitive user interface for controlling portable media device 100 and in some embodiments any accessories to which portable media device 100 is electrically or wirelessly coupled. In some embodiments, portable media device 100 can include additional controls such as, for example, button 104. Portable media device 100 can also include multiple hard-wired input/output (I/O) ports that include digital I/O port 106 and analog I/O port 108. Accessory device 110 can take the form of an audio device that includes two separate earbuds 112 and 114. Each of earbuds 112 and 114 can include wireless receivers or transceivers capable of establishing a wireless link 116 with portable media device 100. Accessory device 120, which can also be compatible with portable media device 100, can take the form of a wired audio device that includes earbuds 122 and 124. Earbuds 122 and 124 can be electrically coupled to each other and to a connector plug 126 by a number of wires. In embodiments where connector plug 126 is an analog plug, audio drivers within earbuds 122 and 124 can receive power through analog I/O port 108 while transmitting data by way of a wireless protocol such as Bluetooth, Wi-Fi, or the like. In embodiments where connector plug 126 interacts with digital I/O port 106, sensor data and audio data can be freely passed through the wires during use of portable media device 100 and accessory device 120. It should be noted that earbuds 122 and 124 can be swappable between left and right ears when the wire attached to each earbud is attached along a line of symmetry of each earbud, or alternatively when the wire is attached by a pivoting coupling. It should also be noted that stereo channels can be swapped between wires when attached to digital I/O port 106.

Figure 2:
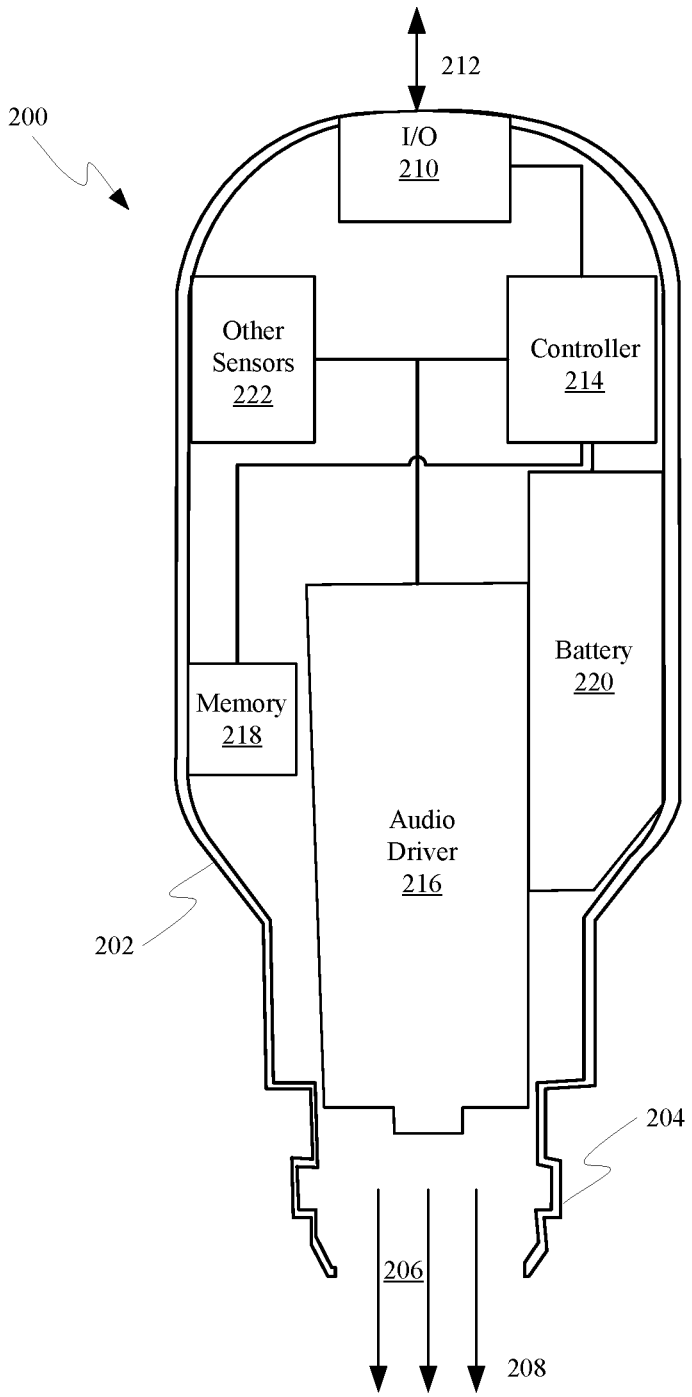
FIG. 2 shows a block diagram illustrating exemplary internal components of an earbud.

FIG. 2 shows a schematic view of an earbud 200 that can be incorporated into accessory device 110 as earbud 112 and/or earbud 114 or incorporated into accessory device 120 as earbud 122 and/or earbud 124. In some embodiments, earbud 200 can include a housing 202. Housing 202 can have a size and/or shape that allows it to be easily inserted within the ear of an end user. Housing 202 also defines an interior volume within which numerous electrical components can be distributed. Housing 202 can also include a nozzle 204 that protrudes from one end of housing 202 and defines an opening 206, which provides a channel by which audio signals can pass into the ear canal of a user of earbud 200, as indicated by the arrow 208. Nozzle 204 can be arranged along a longitudinal axis of housing 202 so that any audio generated within housing 202 can exit directly out of housing 202, without having to be channeled through any angles, which could adversely affect audio quality provided by earbud 200.

Earbud 200 can also include an I/O interface 210 that can be configured to transmit and receive information from another device such as, for example, portable media device 100 by way of link 212. Link 212 can be generated in various ways. For example, link 212 can be a wireless link when I/O interface 210 takes the form of a wireless transceiver suitable for use in an accessory such as accessory device 110 depicted in FIG. 1. I/O interface 210 is depicted at an opposite end of earbud housing 202 from opening 206 so that a wireless transceiver associated with I/O interface 210 can be separated from a user of earbud 200 as much as possible. This configuration can advantageously reduce an amount of interference or signal blockage caused by the user. Alternatively, link 212 can be transmitted over a wired connector such as the wires of accessory device 120. In addition to providing a conduit for receiving power, I/O interface 210 can also be used to receive audio content that can be processed by controller 214 and sent on to audio driver 216. While audio driver 216 is depicted as a single component, audio driver 216 could be divided into high and low frequency audio drivers. It should also be noted that the linear shape of housing 202 also helps increase a quality of sound delivered to an ear of a user by audio driver 216. Because of the linear configuration, audio driver 216 can be positioned very close to opening 206. In general, the larger the volume of the channel between audio driver 216 and opening 206 the more the audio signal is degraded. In particular, the high frequency sound waves suffer the most as the channel between the exit to audio driver 216 and opening 206 increases in volume. For this reason, when audio driver 216 is split into high and low frequency audio drivers, the high frequency audio driver gets positioned as close as feasibly possible to opening 206 while the low frequency audio driver can be squeezed in wherever if fits.

I/O interface 210 can also receive control signals from a device similar to portable media device 100 for accomplishing tasks such as adjusting a volume output of audio driver 216. When I/O interface 210 takes the form of a wireless transceiver, I/O interface 210 can include an antenna configured to transmit and receive signals through an antenna window or an opening defined by housing 202. This type of antenna can be used to transmit data using one or more wireless protocols, e.g. Wifi® and Bluetooth®. The antenna window can be particularly important when housing 202 is formed of radio opaque material. In some embodiments, I/O interface 210 can also represent one or more exterior controls (e.g. buttons and/or switches) for performing tasks such as pairing earbud 200 with another device or adjusting various settings of earbud 200 such as volume or the like.

Earbud 200 can also include a memory storage 218, which can be configured to carry out any number of tasks. For example, memory storage 218 can be configured to store media content when a user of earbud 200 wants to use earbud 200 independent from any other device. In such a use case, memory storage 218 can be loaded with one or more media files for independent playback. When earbud 200 is being used with another device, memory storage 218 can also be used to buffer media data received from the other device. To support independent use cases, memory storage 218 can also be used to store entire media files and/or playlists for later playback independent of any other device. With the possible exception of when I/O interface 210 is a wired interface that can provide power to earbud 200 from another device or power source, battery 220 is generally used for powering operations of earbud 200. Battery 220 can provide the energy needed to perform any of a number of tasks including: maintain a wireless link 212, powering controller 214, powering audio driver 216, and powering one or more sensors 222. While sensors 222 are shown as a generic block, sensors 222 can include sensors such as microphones, orientation sensors, proximity sensors or any other sensor suitable for improving the user experience of earbud 200. It should be noted that sensors 222 are not required in all of the embodiments described herein.

Figure 3A:
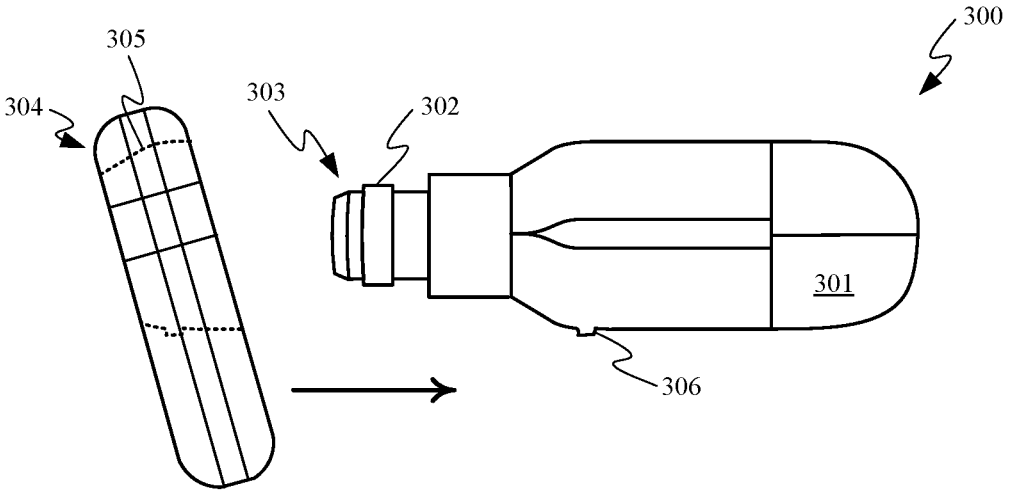
FIG. 3A shows a top view of an earbud housing separated from an anchoring feature.

FIG. 3A shows a top view of earbud 300, which includes housing 301 and nozzle 303. Nozzle 303 can be integrally formed with housing 301 and arranged to provide an exit for audio leaving earbud housing 301. In some embodiments, nozzle 303 can take the form of a tapered exit portion of housing 301. Nozzle 303 can also include one or more ridges 302 configured to interact with an earbud tip to keep the earbud tip seated on nozzle 303. FIG. 3A also depicts anchoring feature 304. Anchoring feature 304 can be formed from an elastomeric substrate having a size and shape that corresponds with interior features of the ear such as the tragus, anti-tragus and concha of the ear. Anchoring feature 304 defines a housing opening 305 extending through anchoring feature 304. Housing opening 305 can have a shape and size in accordance with an exterior surface of housing 301. In some embodiments, earbud 300 can include locking feature 306. Locking feature 306 can take many forms including but not limited to a protrusion or recess configured to interact with a respective recess or protrusion disposed within housing opening 305 and defined by anchoring feature 304.

Figure 3B:
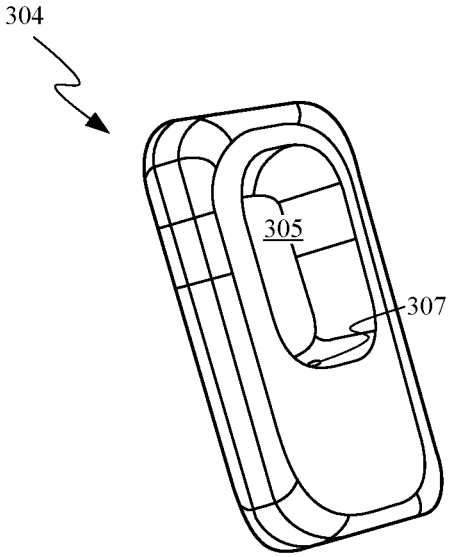
FIG. 3B shows a perspective view of the anchoring feature depicted in FIG. 3A.

FIG. 3B shows a perspective view of anchoring feature 304. In particular, anchoring feature 304 is shown rotated so that housing opening 305 can be seen. FIG. 3B shows how housing opening 305 extends entirely through anchoring feature 304. Housing opening 305 is tapered to match the geometry of housing 301 and to prevent insertion of housing 301 too far through anchoring feature 304. In some cases, the tapered geometry can prevent nozzle 303 of housing 301 from being shoved too far into the ear of a user. FIG. 4B also depicts recess 307, which is configured to interact with locking feature 306 to prevent housing 301 from inadvertently slipping out of housing opening 305 during use.

Figure 3C:
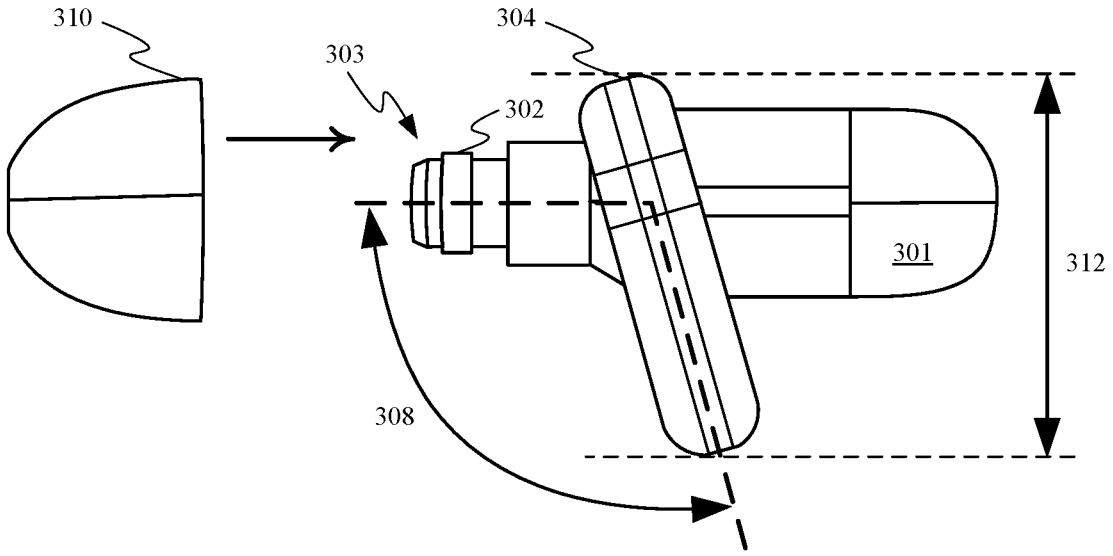
FIGS. 3C-3D show top views of the earbud housing and anchoring feature depicted in FIG. 3A.

FIG. 3C shows anchoring feature 304 installed upon housing 301. This positioning is achieved by sliding anchoring feature 304 over nozzle 303 and onto a central portion of housing 301. A tapered geometry of nozzle 303 interacts with housing opening 305 to prevent housing 301 from being pressed too far into anchoring feature 304. Locking feature 306 helps to keep anchoring feature 304 securely in place with respect to housing 301 by opposing removal of housing 301 from anchoring feature 304. As depicted, anchoring feature 304 is positioned at an angle 308 with respect to nozzle 303 of earbud housing 301. Angle 308 can vary widely between about 100 degrees and 145 degrees. For example, small groups of people could request anchoring feature 304 be configured with angle 308 at one or the other end of the aforementioned range. In some embodiments, where the device is geared towards a broader segment of the population, anchoring feature 304 could make an angle 308 with respect to housing 301 that can vary between about 110 degrees and 120 degrees. Some variance in that angle can be on account of an amount of give in the coupling between anchoring feature 304 and housing 301; however it should be understood that by varying the geometry of housing opening 305 angle 308 of housing 301 with respect to anchoring feature 304 can be adjusted.

While FIG. 3C shows an angle 308 it should also be understood that an angle between anchoring feature 304 and housing 301 can vary in and out of the page as well to accommodate an upward sloping orientation of the ear canal. This upward sloping angle can be on the order of between 20 and 30 degrees. Clearly this type of configuration allows a user to substitute replacement or alternately shaped anchoring features 304 to housing 301. In this way, a user can optimize a fit and feel of earbud 200. Alternately shaped anchoring feature 304 can have curvatures and sizes compatible with various ages and demographic types. Furthermore, various types and sizes of anchoring features 304 can be sold by third parties. While an elastomeric material is specified it should be appreciated that any number of materials could be applied to form anchoring feature 304. The elastomeric material could take many forms including: thermoplastic elastomers, rubber, silicone, foam and the like.

FIG. 3C also depicts an earbud tip 310 formed of elastomeric material. Earbud tip 310 is depicted in its undeformed shape. While earbud tip 310 is depicted having a substantially parabolic shape, it should be understood that any earbud shape is possible and that earbud tip 310 can be formed from any number of deformable materials including but not limited to silicone, rubber, and foam. Earbud tip 310 fits over a portion of nozzle 303 of housing 301. Nozzle 303 is configured to direct audio out of housing 301 and into the ear canal of a user through an opening defined by a central portion of earbud tip 310. Dimension 312 shows one dimension of anchoring feature 304 with respect to a particular orientation of earbud 300. Dimension 312 can represent a distance on the order of between 15 and 25 mm.

Figure 3D:
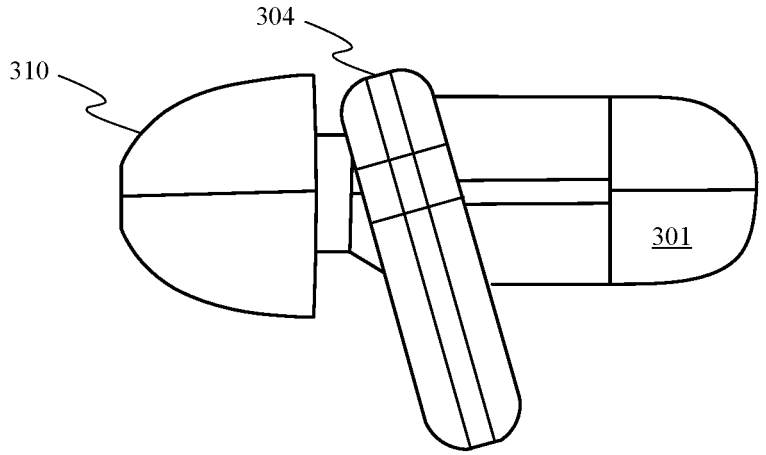

FIG. 3D shows earbud tip 310 mounted onto nozzle 303. Ridges 302 of nozzle 303 can help maintain a robust connection between earbud tip 310 and nozzle 303. Attaching earbud tip 310 to nozzle 303 can prevent anchoring feature 304 from becoming completely dislodged from earbud 200 as earbud tip 310 increases a diameter of the end over which anchoring feature 304 was installed upon earbud housing 301. In this way, even if anchoring feature 304 were to become dislodged from locking feature 306 earbud tip 310 could oppose the inadvertent separation of anchoring feature 304 and housing 301, thereby preventing the two from becoming disconnected and/or lost. It should be noted that while a removable anchoring feature 304 has been discussed, anchoring feature 304 can also be permanently affixed to earbud housing 301 by for example an adhesive.

Figure 4A:
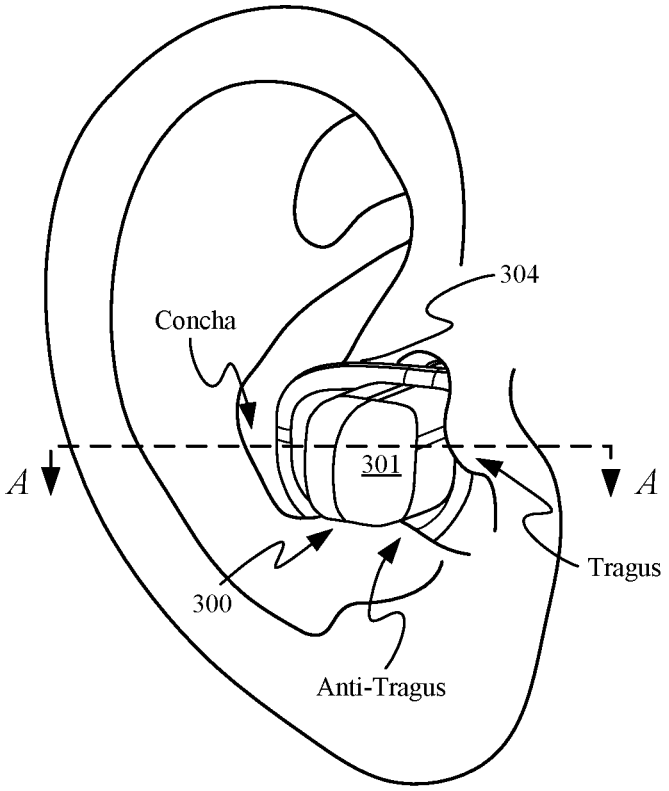
FIGS. 4A-4B show perspective views of an earbud positioned within the ear of a user.
Figure 4B:
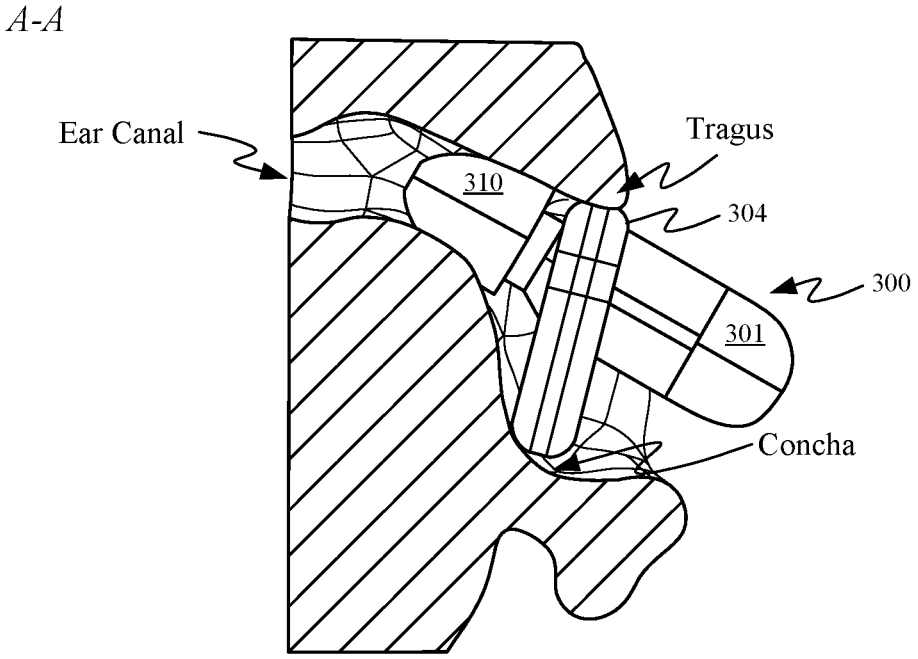

FIG. 4A shows an earbud housing 301 of earbud 300 positioned within the ear of a user. As depicted anchoring feature 304 is positioned within the ear of a user, seated behind the anti-tragus, thereby providing stability and comfort. Anchoring feature is also tucked behind the tragus. These two points of contact between anchoring feature 304 and the features of the ear in addition to earbud tip 310 being sealed within the ear canal provide a secure position capable of resisting various shocks or bumps experienced while walking or running. In some embodiments, anchoring feature 304 can be large enough to contact the concha of the ear for a third point of contact.

FIG. 4B shows a cross-sectional top view of earbud 300 within the ear of the user. An earbud tip 310 is shown sealed within the ear canal of the ear so that it seals the ear canal of the user. FIG. 4B also shows how anchoring feature 304 can be positioned between the tragus and concha of the ear of the user. While FIG. 4B shows how far earbud housing can stick out of the ear, the secure fit of anchoring feature 304 within the interior of the ear keeps earbud housing firmly secured within the ear of the user. In some embodiments, this large protrusion can advantageously place an antenna well outside of the ear to improve operation of the antenna. Furthermore, in embodiments where earbud 300 includes a wire, dangling the wire off the distal end of earbud housing 301 can reduce the occurrence of contact between the wire and the user.

Figure 4C:
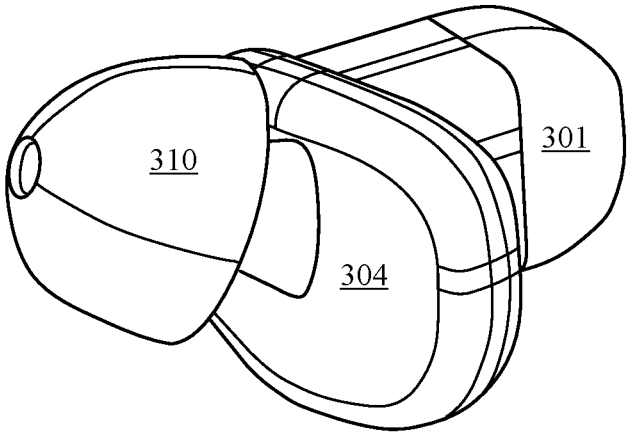

FIG. 4C shows a perspective view of earbud 300 removed from the ear. Earbud tip 310 is now depicted in its undeformed shape and having a substantially parabolic shape. It should be appreciated that any earbud shape is possible and that earbud tip 310 can be formed from any number of deformable materials including but not limited to silicone, rubber, and foam. Earbud tip 310 fits over a portion of nozzle 303 of housing 301. Nozzle 303 is configured to direct audio out of housing 301 and into the ear canal of a user through an opening defined by a central portion of earbud tip 310. In some embodiments, nozzle 303 can be an extension of and rigidly coupled with housing 301. FIG. 4C also depicts how earbud tip 310 can be oriented upwards to match the upward sloping geometry of an ear canal. In this way, earbud 300 can more easily and comfortably sit within the ear of the user. An angle between earbud housing 301 and earbud tip 310 can be about 20-25 degrees. In some embodiments, nozzle 303 can be rotatably coupled with housing 301 so that nozzle 303 can be shifted with respect to housing 301. In such an embodiments, movement of nozzle 303 with respect to housing 301 can be limited to one axis of rotation or alternatively may be configured to rotate about multiple axes of rotation.

Figure 4D:
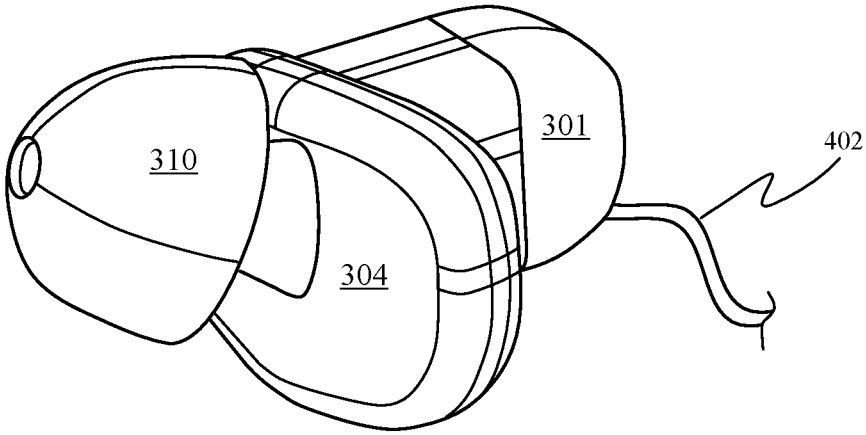

FIG. 4D shows another perspective view of earbud 300 and how earbud 300 can include a wire 402 that carries power and/or data to earbud 300. In embodiments with a wire 402 earbud 300 may not need either an antenna, or a battery for operation. This can allow additional room for other sensors, or a bigger audio driver unit. In some embodiments, earbud 300 can still be a wireless earbud with the exception of wire 402 providing an electrically conductive pathway between earbud 300 and another earbud 300 similar to earbud 300. This can allow circuitry and electrical components to be distributed between earbuds 300. In some embodiments, one of earbuds 300 could include a battery and the other could include an antenna. Similarly, both earbuds could include the same components which could provide redundancy in the event of a component failure or additional storage capability in the case of batteries or memory storage devices.

Figure 5A:
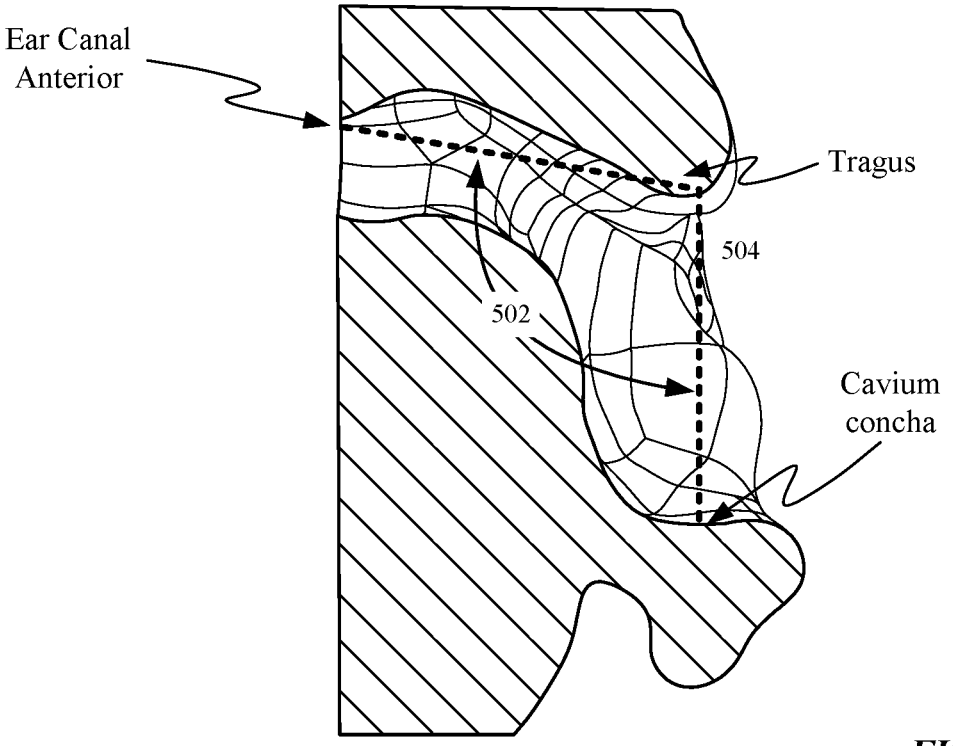
FIGS. 5A-5B show cross-sectional views of an ear illustrating internal ear geometries.
Figure 5B:
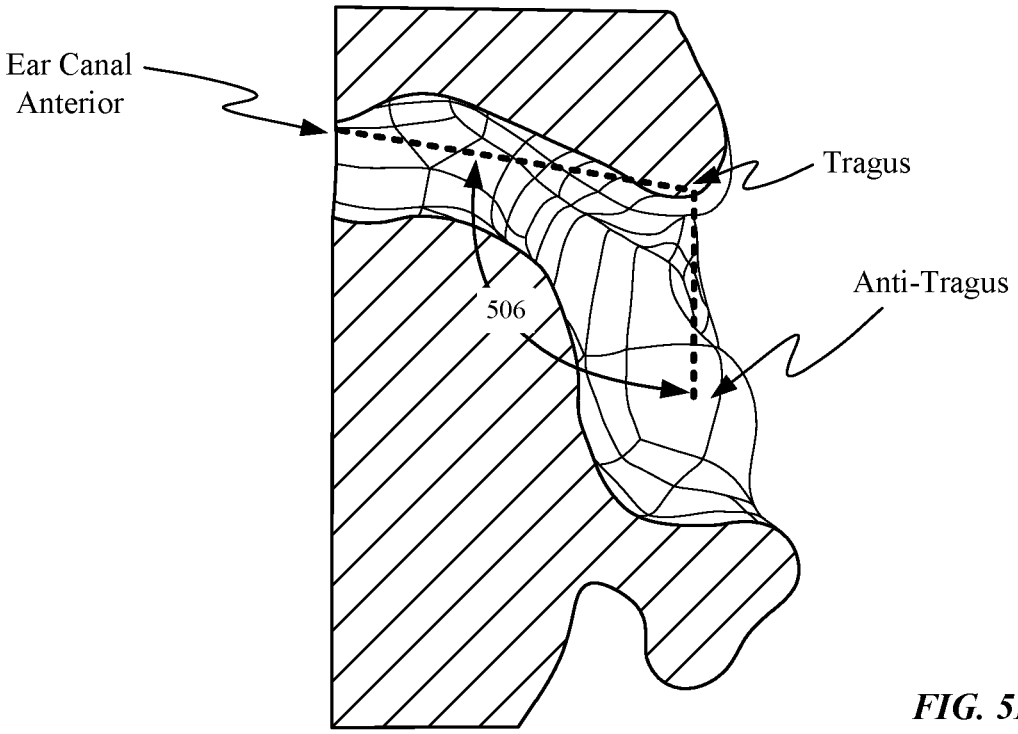

FIGS. 5A-5B show cross-sectional views of an ear of a user in accordance with section line A-A of FIG. 4A. FIG. 5A depicts an average angle 502 between the ear canal anterior and the cavium concha being about 115-120 degrees with a standard deviation of about 14 degrees. FIG. 5A also shows a distance 504 between the tragus and the cavium concha being between 17 and 22 mm. Consequently, an anchoring feature engaged with the cavium concha would tend to perform best when an angle between the anchoring feature and the earbud housing was between 101 degrees and 134 degrees. FIG. 5B shows an angle 506 between the ear canal anterior and the anti-tragus as being between about 100 and 110 degrees with a standard deviation of about 11 degrees. Consequently, an anchoring feature engaged with the anti-tragus would tend to perform best when an angle between the anchoring feature and the earbud housing was between 89 degrees and 121 degrees. An anchoring feature design configured to cover both possibilities would likely set the angle up within an overlapping portion of the aforementioned range, in this case being between 101 and 121 degrees.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An earbud, comprising:

an anchoring feature defining a channel extending from an first opening in a first face of the anchoring feature to a smaller second opening in an opposing second face of the anchoring feature, the anchoring feature being sized to be secured within an ear of a user;

an earbud housing comprising a speaker housing and a nozzle defining an audio port and extending away from the speaker housing, wherein the nozzle has a first diameter and the speaker housing includes a central section disposed between opposing first and second faces of the earbud housing, the central section including a portion disposed within the channel defined by the anchoring feature and having a second diameter that is greater than the first diameter; and an audio driver disposed within the speaker housing portion of the earbud housing and aligned to emit sound through the audio port and exiting an audio exit opening at the first of the earbud housing.

2. The earbud of claim 1 wherein the nozzle extends away from the earbud housing at an angle between 20 and 25 degrees.

3. The earbud of claim 1 further comprising an earbud tip engaged over the nozzle.

4. The earbud of claim 3 wherein an interior surface of the earbud tip is engaged with an exterior surface of the nozzle.

5. The earbud of claim 3 wherein a portion of the anchoring feature extends away from the housing at an angle that allows the anchoring feature to be positioned between the tragus and concha of a user's ear when the earbud tip is inserted into the user's ear canal.

6. The earbud of claim 5 wherein the anchoring feature engages a locking feature of the earbud housing to maintain an angular offset between the portion of the anchoring feature extending away from the housing and an axis extending longitudinally through the nozzle.

7. The earbud of claim 6 wherein the angular offset is between 100 and 145 degrees.

8. The earbud of claim 1 wherein the anchoring feature comprises an elastomeric member.

9. The earbud of claim 8 wherein the elastomeric member is removable from the earbud housing.

10. The earbud of claim 1 wherein the earbud is a wireless earbud comprising a wireless receiver and an antenna.

11. The earbud of claim 10 wherein the wireless earbud comprises a battery.

12. An earbud comprising:

an earbud housing having a speaker housing and a nozzle extending away from the speaker housing and an acoustic port formed through the nozzle, wherein the nozzle has a first diameter and the speaker housing has a second diameter that is greater than the first diameter;

a speaker disposed within the earbud housing and aligned to emit sound through the acoustic port;

a removable earbud tip formed of a deformable material and having a central opening sized and shaped to be inserted over the nozzle to attach the removable earbud tip to the earbud housing; and a removable anchoring feature formed of a deformable material and having an opening sized and shaped to enable the removable anchoring feature to be inserted over the speaker housing to attach the removable anchoring feature to the speaker housing having the second diameter such that an anchoring portion of the removable anchoring feature extends away from the earbud housing at an angle that allows the anchoring portion to be positioned between the tragus and concha of a user's ear when the earbud tip is inserted into the user's ear canal.

13. The earbud of claim 12 wherein an angle between the anchoring portion and an axis extending longitudinally through the nozzle is between 100 and 145 degrees.

14. The earbud of claim 12 wherein the earbud housing comprises a locking feature securing the removable anchoring feature to the earbud housing.

15. The earbud of claim 12 wherein the anchoring feature comprises an elastomeric material.

16. The earbud of claim 12 wherein the nozzle extends away from the earbud housing at an angle between 20 and 25 degrees.

17. The earbud of claim 12 wherein the earbud is a wireless earbud and further comprises a wireless receiver and an antenna.

18. The earbud of claim 17 wherein the wireless earbud further comprises a battery.

19. The earbud of claim 12 wherein an interior surface of the central opening of the removable earbud tip is in direct contact with an exterior surface of the nozzle when the earbud tip is attached to the nozzle.

* * * * *